US012110147B2

(12) United States Patent
Lopes

(10) Patent No.: US 12,110,147 B2
(45) Date of Patent: Oct. 8, 2024

(54) HORIZONTAL FORMING DEVICE

(71) Applicant: Syntegon Packaging Systems AG, Beringen (CH)

(72) Inventor: Michael Lopes, Stockach (DE)

(73) Assignee: Syntegon Packaging Systems AG, Beringen (CH)

( * ) Notice: Subject to any disclaimer, the term of this patent is extended or adjusted under 35 U.S.C. 154(b) by 97 days.

(21) Appl. No.: 17/921,453

(22) PCT Filed: Oct. 15, 2021

(86) PCT No.: PCT/EP2021/078662
§ 371 (c)(1),
(2) Date: Oct. 26, 2022

(87) PCT Pub. No.: WO2022/079268
PCT Pub. Date: Apr. 21, 2022

(65) Prior Publication Data

US 2023/0159194 A1 May 25, 2023

(30) Foreign Application Priority Data

Oct. 16, 2020 (DE) ..... 10 2020 127 376.2

(51) Int. Cl.
*B65B 9/06* (2012.01)
*B65B 9/22* (2006.01)

(52) U.S. Cl.
CPC ..... *B65B 9/06* (2013.01); *B65B 9/22* (2013.01); *B65B 2009/063* (2013.01)

(58) Field of Classification Search
CPC ..... B65B 9/06; B65B 9/22; B65B 2009/063
See application file for complete search history.

(56) References Cited

U.S. PATENT DOCUMENTS 3,415,171 A * 12/1968 Wilson ..... B65B 59/001 53/551
4,494,362 A * 1/1985 Koch ..... B65B 9/06 53/550

(Continued)

FOREIGN PATENT DOCUMENTS

DE 1586334 B1 3/1972
DE 69819402 T2 5/2004

(Continued)

OTHER PUBLICATIONS

German Patent Office Search Report for Related Application No. DE 10 2020 127 376.2 dated Jan. 29, 2021 (10 pages, including an English translation).

(Continued)

*Primary Examiner* — Thomas M Wittenschlaeger
*Assistant Examiner* — David G Shutty
(74) *Attorney, Agent, or Firm* — Michael Best & Friedrich LLP

(57) ABSTRACT

A horizontal forming device, in particular for horizontal flow pack machines, comprises at least one, in particular roller-free, forming unit, in particular a forming shoulder, and comprises at least one support unit, which are configured for forming a packaging material web into a packaging material tube, wherein the forming unit and the support unit together delimit a guiding gap which the packaging material web can be guided through, the horizontal forming device further comprising at least one compensation unit, which is configured to movably support the forming unit and/or the support unit in such a way that, at least during a forming of the packaging material tube, the forming unit and the support unit are movable relative to each other, in particular in order to enable a compensation movement of the forming unit and/or the support unit relative to each other during a forming of the packaging material tube.

14 Claims, 4 Drawing Sheets

(56) References Cited

U.S. PATENT DOCUMENTS

| | | | | | |
|---|---|---|---|---|---|
| 5,255,495 | A * | 10/1993 | Kovacs | B65B 59/001 | 53/550 |
| 5,408,806 | A * | 4/1995 | Lin | B65B 9/06 | 53/550 |
| 5,799,467 | A * | 9/1998 | Nankervis | B65B 25/146 | 53/550 |
| 5,987,860 | A * | 11/1999 | Yang | B65B 9/067 | 53/550 |
| 6,457,300 | B1 * | 10/2002 | Yang | B65B 59/02 | 53/550 |

FOREIGN PATENT DOCUMENTS

| | | | | | |
|---|---|---|---|---|---|
| FR | 1477482 | A | 4/1967 | | |
| JP | 8505191 | A | 1/1975 | | |
| JP | 85137460 | U | 3/1976 | | |
| JP | H0387607 | U | 9/1991 | | |
| WO | 2020058532 | A1 | 3/2020 | | |
| WO | WO-2020058531 | A2 * | 3/2020 | B65B 59/003 | |
| WO | WO-2020058532 | A4 * | 5/2020 | B65B 59/003 | |

OTHER PUBLICATIONS

International Search Report and Written Opinion for Related Application No. PCT/EP2021/078662 dated Feb. 2, 2022 (12 pages, including an English translation).

* cited by examiner

HORIZONTAL FORMING DEVICE

CROSS REFERENCE TO RELATED APPLICATIONS

This application is based on and incorporates herein by reference PCT patent application PCT/EP2021/078662 filed on Oct. 15, 2021 and German patent application DE 10 2020 127 376.2 filed on Oct. 16, 2020.

BACKGROUND

Horizontal forming devices, in particular for horizontal flow pack machines, are already known, the known horizontal forming devices comprising at least one, in particular roller-free, forming unit, in particular a forming shoulder, and at least one support unit, which are configured for forming a packaging material web, in particular a paper web, into a packaging material tube, wherein the forming unit and the support unit together delimit a guiding gap which the packaging material web can be guided through.

SUMMARY

The invention is based on a horizontal forming device, in particular for horizontal flow pack machines, with at least one, in particular roller-free, forming unit, in particular a forming shoulder, and with at least one support unit, which are configured for forming a packaging material web, in particular a paper web, into a packaging material tube, wherein the forming unit and the support unit together delimit a guiding gap which the packaging material web can be guided through.

It is proposed that the horizontal forming device comprises at least one compensation unit which is configured to movably support the forming unit and/or the support unit in such a way that, at least during a forming of the packaging material tube, the forming unit and the support unit are movable relative to each other, in particular in order to enable a compensation movement of the forming unit and/or the support unit relative to each other during a forming of the packaging material tube. "Configured" is in particular to mean specifically implemented, specifically programmed, specifically designed and/or specifically equipped. By an object being configured for a certain function is in particular to be understood that the object fulfills and/or carries out said certain function in at least one application state and/or operation state. It is conceivable that only the forming unit is movably supported by means of the compensation unit, that only the support unit is movably supported by means of the compensation unit, or that the forming unit and the support unit are movably supported by means of the compensation unit, in order to enable a compensation movement of the forming unit and/or the support unit relative to each other while forming the packaging material tube. The compensation unit is preferably provided in addition to a gap adjusting unit, by means of which a gap width of the guiding gap is adjustable. It is however also conceivable that an adjustment function for an adjustment of a gap width of the guiding gap is integrated in the compensation unit. The compensation unit is preferentially configured to movably support the forming unit and/or the support unit in such a way that the forming unit and/or the support unit are/is movable relative to each other during a running operation of a packaging machine, in particular a horizontal flow pack machine, comprising the horizontal forming device. The compensation unit is preferentially configured to movably support the forming unit and/or the support unit in such a way that during a running of the packaging material web through the guiding gap, the forming unit and/or the support unit are movable relative to each other, in particular in the case of variation of a maximum thickness of the packaging material web due, for example, to a connection element, in particular adhesive splicing tape, arranged on the packaging material web, due to an at least temporarily two-layer packaging material web or the like, after changing the packaging material web or the like, while the packaging material web is running through the guiding gap. The forming unit and/or the support unit can be moved by means of the compensation unit actively or the forming unit and/or the support unit may be movably supported by means of the compensation unit in such a way that the forming unit and/or the support unit are moved relative to each other passively by the packaging material web running through the guiding gap, in particular in the case of a variation of a maximum thickness of the packaging material web due, for example, to a connection element, in particular adhesive splicing tape or the like, arranged on the packaging material web, due to an exchange of the packaging material web or something like that. The forming unit and/or the support unit preferably execute an evasive movement, in particular in the case of a variation of a maximum thickness of the packaging material web. The compensation unit may be configured to movably support the entire forming unit and/or the entire support unit, or may be configured to movably support only individual elements of the forming unit and/or the support unit, in order to enable a compensation movement during a forming of the packaging material tube. Further possibilities, deemed expedient by someone skilled in the art, for a movement of the forming unit and/or of the support unit relative to each other by means of the compensation unit in order to enable a compensation movement of the forming unit and/or of the support unit relative to each other during a forming of the packaging material tube are also conceivable. The compensation unit may be implemented such that it is possible to realize a continuous maximum compensation movement path or a maximum compensation movement path that is adjustable step-wise, in particular by a maximum compensation movement path of the forming unit relative to the support unit being adjustable continuously or step-wise, by a maximum compensation movement path of the support unit relative to the forming unit being adjustable continuously or step-wise, or by a maximum compensation movement path of the forming unit and the support unit relative to each other being adjustable continuously or step-wise.

Preferably the forming unit is configured to form the packaging material tube at least section-wise around the support unit, in particular around outer edges of the support unit. The forming unit is preferably configured to deflect the packaging material web. In particular, a packaging material feeding unit of the packaging machine is configured to feed the packaging material web to the forming unit along a direction that runs transversely, in particular at least substantially perpendicularly, to the transport direction. The forming unit preferably has at least one folding edge around which the packaging material web is deflectable. Preferentially the folding edge is embodied as a shoulder edge and the forming unit is embodied as a forming shoulder. In particular, the forming unit is implemented free of rollers for a deflection of the packaging material web. Preferably the forming unit is configured to deflect the packaging material web at the folding edge in a direction transversely to the run-in direction of the packaging material web and transversely to the transport direction. In particular, the folding edge extends at least substantially perpendicularly to the run-in direction of the packaging material web and to the transport direction. In particular, the folding edge is configured to create a homogeneous material tension in the packaging material. The forming unit preferably has at least two form-contour edges which extend, starting from the folding edge, transversely to the folding edge, in particular in a V shape. In particular, the packaging material web is reformable into the packaging material tube around the form-contour edges. Preferably the form-contour edges extend along a running direction of the packaging material and/or along an outer contour of the fed-in products from the folding edge to a forming tunnel of the forming unit, which is configured to guide the packaging material web along the transport direction. In particular, a longitudinal axis of the forming tunnel extends at least substantially parallel to the transport direction. The forming tunnel preferably delimits the guiding gap at least partially. The forming tunnel is preferentially arranged on a side of the forming unit that faces toward the support unit and/or toward a support surface of the horizontal forming device. Preferentially the folding edge is formed at least partially by an edge of a forming element of the forming unit and an edge of a further forming element of the forming unit.

The support unit is arranged at least partially in a region of the forming tunnel of the forming unit. Preferentially the support unit is implemented at least partially so as to correspond to the forming tunnel of the forming unit. In particular, the guiding gap is delimited by the forming tunnel of the forming unit and at least by that portion of the support unit that is arranged in the region of the forming tunnel of the forming unit. Preferentially an, in particular minimum, distance between a wall of the forming tunnel of the forming unit and an outer surface of the portion of the support unit that is arranged in the region of the forming tunnel of the forming unit defines an, in particular maximum, gap width of the guiding gap. The support unit is arranged at least partially inside the forming tunnel of the forming unit. Preferably the support unit extends at least partially into the forming tunnel of the forming unit. The support unit may comprise at least one support element that is realized in a U shape, in particular a U-shaped support element that is embodied correspondingly to a U-shaped implementation of the forming tunnel of the forming unit, or the support unit comprises at least two, in particular L-shaped, support elements, in particular support legs, in particular two L-shaped support elements which are embodied so as to correspond to a U-shaped implementation of the forming tunnel of the forming unit. Preferably, during a forming of the packaging material tube, the packaging material web is guided through between the forming unit, in particular the forming tunnel of the forming unit, and the support unit, in particular in a manner that is already known to someone skilled in the art.

Preferably the horizontal forming device is part of the packaging machine, in particular the horizontal flow pack machine. In particular, the horizontal forming device is configured to guide a packaging material, in particular the packaging material tube, along a horizontal transport direction, which in particular runs at least substantially perpendicularly to a gravity force direction. The term "substantially perpendicularly" is in particular meant to define an orientation of a direction relative to a reference direction, wherein the direction and the reference direction, in particular viewed in a projection plane, include a 90° angle, the angle having a maximum deviation that is in particular smaller than 8°, advantageously smaller than 5° and especially advantageously smaller than 2°.

Preferably the horizontal forming device is configured at least for a forming and/or guiding of a packaging material web, the packaging material being preferentially realized as a paper. In particular, the packaging material web is realized as a paper web. The packaging material is preferentially realized as a packaging paper. The horizontal forming device may alternatively or additionally be configured for a forming and/or guiding of a packaging material web wherein the packaging material is realized differently from a paper, for example as a synthetic material. In particular, the packaging material web may alternatively be realized of a synthetic material. By a "packaging material web" is in particular a planar, in particular two-dimensional, configuration of the packaging material, in particular the packaging paper, to be understood. Preferably the packaging machine comprises at least one packaging material wind-off unit which is configured to accommodate the packaging material, in particular as a packaging material reel. Preferably the packaging material wind-off unit is configured to wind the packaging material off as a packaging material web, in particular to feed the packaging material to a packaging material feeding unit of the packaging machine. The packaging material feeding unit is in particular configured for feeding the packaging material web to the horizontal forming device, in particular the forming unit. The packaging material feeding unit may comprise a plurality of components, in particular components known to someone skilled in the art, like for example at least one oscillating lever, at least one centering feeler, at least one web-edge guide control and/or at least one printing unit for printing the packaging material.

By a "packaging material tube" is in particular an, in particular three-dimensional, configuration of the packaging material, in particular the packaging paper, to be understood, which is in particular re-formed at least transversely to a web plane of the packaging material web. In particular, the packaging material tube is configured to envelop products that are to be packaged. The packaging material tube is in particular configured for a packaging, in particular for an enveloping, of products, in particular food products. In particular, the packaging machine comprises at least one product feeding unit, in particular a conveyor belt, a driver chain, a linear drive system of the kind distributed, for example, by the Beckhoff company under the designation "Linear Transport System XTS (eXtended Transport System)", or something like that, the at least one product feeding unit being configured to transport the products that are to be packaged into a region of the horizontal forming device, particular the forming unit, for an enveloping by the packaging material tube. Preferably a transport direction of the products runs at least substantially parallel to a transport direction. "Substantially parallel" is in particular to mean an orientation of a direction relative to a reference direction, in particular in a plane, wherein the direction has a deviation from the reference direction that is in particular smaller than 8°, advantageously smaller than 5° and especially advantageously smaller than 2°. Preferably the product feeding unit is arranged along the transport direction upstream of the horizontal forming device, in particular of the forming unit.

Preferably the packaging machine comprises at least one longitudinal sealing unit, which is configured to create, in particular via heat input into the packaging material and/or via pressure onto the packaging material, a longitudinal sealing seam of the packaging material tube, which in particular extends at least substantially parallel to the transport direction. The longitudinal sealing unit is arranged along the transport direction downstream of the horizontal forming device. In particular, the longitudinal sealing unit comprises at least one pair of sealing rollers which can be subjected to pressure and/or heat, which are in particular provided with a profile, and which are configured to transport the packaging material tube, in particular by rotation. Preferably the longitudinal sealing unit comprises a plurality of sealing roller pairs, wherein at least one first sealing roller pair is arranged along the transport direction after the horizontal forming device and is implemented to be free of heating, in particular for a heating-free transport of the packaging material tube. However, it is also conceivable that the first sealing roller pair is implemented to be heated. Preferably the packaging machine comprises at least one transversal sealing unit, which is configured, in particular after respectively one product, to create transversal sealing seams of the packaging material tube, which in particular extend at least substantially perpendicularly to the transport direction, in particular via selective pressure onto the packaging material and/or via heat input into the packaging material.

For a heat input, the transversal sealing unit may, for example, comprise an ultrasound unit, an induction unit or a different heating unit that is deemed expedient by someone skilled in the art, which may also be partially integrated in jaws of the transversal sealing unit. In particular, the transversal sealing unit is configured for singulating the packaging material tube into individual packagings, which in particular enclose one product respectively. The transversal sealing unit is arranged along the transport direction downstream of the longitudinal sealing unit.

The implementation of the horizontal forming device according to the invention advantageously enables precise re-forming of a packaging material web into a packaging material tube. Advantageously, packaging material webs made of delicate, in particular tear-prone and/or very thin, materials, in particular paper, can be re-formed into packaging material tubes. Advantageously, at least substantially crease-free packaging material tubes are producible. It is possible to provide a horizontal forming device with an advantageously compact implementation. Advantageously, precise guiding of the packaging material web is achievable during a forming of the packaging material tube, in particular also in the case of a variation of a maximum thickness of the packaging material web. It is advantageously possible to counteract a damaging, like for example rupture, of the packaging material web, in particular due to a maximum thickness of the packaging material web that is too great for the set gap-width of the guiding gap, caused for example by an adhesive splicing tape arranged on the packaging material web, or the like. Advantageously a stable production process is enabled.

It is further proposed that the compensation unit is configured to movably support at least one forming element of the forming unit and/or at least one support element of the support unit by means of at least one spring-preloaded compensation element of the compensation unit. Preferably the spring-preloaded compensation element is arranged, in particular fixed, with at least one side at the forming element or the support element. It is however also conceivable that the spring-preloaded compensation element is realized in a one-part implementation with the forming element or the support element. "In a one-part implementation" is in particular to mean at least connected by substance-to-substance bond, for example by a welding process, a gluing process, an injection-molding process and/or a different process deemed expedient by someone skilled in the art, and/or advantageously formed in one piece, like for example by a production from one cast and/or by a production in a one-component or multi-component injection molding procedure and advantageously from a single blank. Preferentially the support unit comprises at least two support elements, which are in each case supported movably by means of at least one spring-preloaded compensation element of the compensation unit. The support elements are preferably implemented, and/or arranged at the forming unit, mirror-symmetrically to each other. It is conceivable that, in particular alternatively or additionally to the support elements, the forming elements of the forming unit are in each case supported movably by means of at least one spring-preloaded compensation element of the compensation unit. It is however also conceivable that, in particular during a forming of the packaging material tube, the forming elements are fixed in a stationary manner, and that the support elements are supported movably at respectively one of the forming elements via the spring-preloaded compensation elements. The compensation element may be spring-preloaded by means of a helical spring, by means of an elastomer, by means of a gas compression spring, by means of an oil compression spring, by means of a spring steel, or by means of a different element deemed expedient by someone skilled in the art, which is suitable for creating a preload. The forming element and/or the support element are preferentially supported by means of the spring-preloaded compensation element so as to be flexibly movable. Preferentially the forming element and/or the support element are supported by means of the spring-preloaded compensation element so as to be movable in such a way that a basic position or a starting point of a movement of the forming element and/or of the support element is—in particular flexibly-adjustable. The implementation of the horizontal forming device according to the invention advantageously allows achieving precise guiding of the packaging material web during a forming of the packaging material tube, in particular also in the case of a variation of a maximum thickness of the packaging material web. It is advantageously possible to counteract a damaging, for example rupture, of the packaging material web, in particular due to a maximum thickness of the packaging material web that is too great for the set gap width of the guiding gap, caused for example by an adhesive splicing tape arranged at the packaging material web, or the like. Advantageously a stable production process is enabled. A compensation movement of the forming unit and/or of the support unit during a forming of the packaging material tube is enabled in a constructionally simple manner.

Furthermore, it is proposed that the compensation unit comprises at least one gear, in particular a guiding gear, for an implementation of a compensation movement of the forming unit and/or of the support unit. The gear may be implemented, for example, as an eccentric gear enabling a compensation movement of the forming unit and/or the support unit, wherein at least one eccentric element of the eccentric gear may be embodied as a spring-preloaded compensation element. The gear may be implemented as a mechanical coupling gear enabling a compensation movement of the forming unit and/or of the support unit, wherein at least one coupling element of the mechanical coupling gear may be embodied as a spring-preloaded compensation element. However, it is also conceivable that the gear has a different implementation deemed expedient by someone skilled in the art. Preferably at least one forming element of the forming unit and/or at least one support element of the support unit are/is arranged, in particular fixed, on at least one gear element, in particular the spring-preloaded compensation element. In particular, the at least one forming element of the forming unit and/or the at least one support element of the support unit are/is supported movably by means of the gear of the compensation unit. The implementation of the horizontal forming device according to the invention advantageously allows achieving precise guiding of the packaging material web during a forming of the packaging material tube, in particular also in the case of a variation of a maximum thickness of the packaging material web. A precise compensation movement of the forming unit and/or the support unit during a forming of the packaging material tube is enabled.

It is also proposed that the gear is configured for an implementation of a compensation movement along at least two directions that extend transversely to each other. Preferably the gear is configured for realizing a compensation movement along a direction that runs at least substantially parallel to the transport direction and a direction that runs at least substantially perpendicularly to the transport direction. Preferentially the gear is configured to realize a superimposition of a translation and a rotation. Preferentially the gear is embodied as a guiding gear, in particular as a parallelogram guiding. It is however also conceivable that the gear has a different implementation, deemed expedient by someone skilled in the art, which is suitable for enabling a compensation movement along at least two directions that run transversely to each other. Preferentially, the gear is configured for a compensation movement of at least one support element of the support unit with respect to the forming unit. Preferably, for realizing a compensation movement of the at least one support element relative to the forming unit, the at least one support element is movable away from the forming unit and along the transport direction by means of the gear. It is however also conceivable that the gear is configured for a compensation movement of at least one forming element of the forming unit relative to the support unit or for a compensation movement of the forming unit and the support unit relative to each other. The implementation of the horizontal forming device according to the invention advantageously allows attaining a reliable compensation movement of the forming unit and/or of the support unit. It is advantageously possible to counteract a clamping-in of the packaging material web during a compensation movement of the forming unit and/or of the support unit. Advantageously a precise guiding of the packaging material web during a forming of the packaging material tube is enabled, in particular also in the case of a variation of a maximum thickness of the packaging material web. It is advantageously possible to counteract a damaging, like for example rupture, of the packaging material web, in particular due to a maximum thickness of the packaging material web that is too great for the set gap width of the guiding gap, caused for example by a splicing adhesive tape arranged at the packaging material web, or something like that.

Beyond this it is proposed that the compensation unit comprises at least one preload element, in particular a spring element, which creates a preload force acting against a compensation movement of the forming unit and/or of the support unit. Preferably the preload element is configured to create a preload force toward a starting position from which the at least one forming element of the forming unit and/or the at least one support element of the support unit are/is movable for carrying out the compensation movement. The preload element may be embodied as a helical tension spring, as a helical pressure spring, as a plate spring, as an elastomer, as a gas compression spring, as an oil compression spring, as a spring steel, or as a different spring element that is deemed expedient by someone skilled in the art. Preferably the preload element acts directly or indirectly onto the compensation element, which is arranged at the at least one forming element of the forming unit and/or at the at least one support element of the support unit. It is also conceivable that the at least one support element of the support unit is supported movably at the at least one forming element of the forming unit, and the preload element is arranged, independently from or together with the compensation element, between the at least one support element of the support unit and the at least one forming element of the forming unit. Further implementations and/or arrangements of the preload element, deemed expedient by someone skilled in the art, are also conceivable. The implementation of the horizontal forming device according to the invention advantageously enables a positioning of the forming unit and/or of the support unit in a starting position, in particular so as to reliably maintain a set gap width of the guiding gap, during an arrangement of the forming unit and/or the support unit that is largely free of movement, during a forming of the packaging material tube. Advantageously a precise guiding of the packaging material web during a forming of the packaging material tube is achievable, in particular also in the case of a variation of a maximum thickness of the packaging material web.

It is moreover proposed that the horizontal forming device comprises at least one adjusting unit and at least one support surface, in particular a work plate, on which products that are to be packaged can be transported, the adjusting unit being configured to support the forming unit, the support unit and the compensation unit such that they are together adjustable relative to the support surface. For an implementation of different packaging material tube geometries, the adjusting unit is preferably configured to support the forming unit, the support unit and the compensation unit such that they are adjustable, in particular in different adjustment planes. It is however also conceivable that the horizontal forming device comprises two adjusting units, wherein one of the two adjusting units is at least configured to adjustably support the forming unit and wherein another one of the two adjusting units is at least configured to adjustably support the support unit. In particular, different packaging material tube geometries may be required for a packaging of different products. In particular, the packaging machine is configured for a packaging of different products, which in particular have different dimensions. In particular, different packaging material tube geometries may be required for the packaging of different products having different maximum extensions at least substantially perpendicularly to the support surface, in particular different heights, and/or having different maximum extensions at least substantially parallel to the support surface and transversely to the transport direction, in particular different widths. In particular, a maximum extension of the packaging material tube at least substantially perpendicularly to the support surface, in particular a height of the packaging material tube, and/or a maximum extension of the packaging material tube at least substantially parallel to the support surface and transversely to the transport direction, in particular a width of the packaging material tube, are/is adjustable by an adjustment of the forming unit and/or of the support unit. Preferably the forming unit, the support unit and the compensation unit are supported so as to be adjustable, in particular together adjustable, in at least one adjustment plane extending on a side of the support surface that faces toward the forming unit. In particular, the forming unit, the support unit and the compensation unit are supported such that they are adjustable as an entire sub-assembly. Preferably the adjusting unit is configured to support the forming unit, the support unit and the compensation unit such that they are translationally movable and/or rotationally movable. Preferably the adjusting unit is configured, in particular for an adjustment of a height of the packaging material tube, to support the forming unit, the support unit and the compensation unit such that they are at least translationally movable along an adjustment direction that runs at least substantially perpendicularly to the support surface. Alternatively or additionally it is conceivable that the adjusting unit is configured to support the forming unit, the support unit and the compensation unit such that they are at least translationally movable along a further adjustment direction that runs at least substantially perpendicularly to the adjustment direction and at least substantially parallel to the transport direction. Preferably the adjusting unit is embodied as a manual adjusting unit for a manual adjustment of the forming unit, the support unit and the compensation unit, in particular as a sub-assembly. Alternatively or additionally, it is conceivable that the adjusting unit comprises at least one automatic adjustment element, in particular a servomotor, which is configured for an automatic adjustment of the forming unit, the support unit and the compensation unit. The adjusting unit may be realized such that a position of the forming unit, the support unit and the compensation unit can be realized, in particular together, in particular with respect to the support surface and/or to the form-guiding unit, continuously or stepwise. In the case of a stepwise adjustment possibility, for example an implementation of the adjusting unit is conceivable with a latching rail for realizing individual latching positions. In the case of a continuous adjustment possibility, it is conceivable that the adjusting unit comprises at least one guiding rail or at least one guiding rod which the forming unit, the support unit and the compensation unit are supported on so as to be movable together, wherein a position can be fixed by means of at least one clamping element, in particular a clamping screw or the like, which acts together with the guiding rail or guiding rod in a form-fit and/or force-fit manner. The support surface preferably forms a cargo track which the products are transportable on. The support surface is preferably arranged in a plane extending at least substantially parallel to the transport direction. Preferably the product feeding unit, the longitudinal sealing unit, in particular the sealing rollers, and/or the transversal sealing unit extend/s at least sectionwise through the support surface. In particular, rotation axes of the sealing rollers of the longitudinal sealing unit run at least substantially perpendicularly to the support surface. Preferably the forming unit is arranged on a side of the support surface on which the products can be transported and on which in particular the packaging material wind-off unit and the packaging material feeding unit are arranged. By the implementation of the horizontal forming device according to the invention, it is advantageously possible to counteract a summing-up of tolerances, in particular concerning an adjustability of the forming unit, the support unit and the compensation unit as a sub-assembly. Advantageously a precise guiding of the packaging material web during a forming of the packaging material tube is enabled, in particular also in the case of a variation of a maximum thickness of the packaging material web. Advantageously adjustability with respect to different packaging material tube geometries is facilitated at the same time as a compensation movement of the forming unit and/or of the support unit during a forming of the packaging material tube is enabled in a constructionally simple manner.

It is also proposed, in particular in at least one implementation of the horizontal forming device according to the invention, that the support unit is arranged at the forming unit and is supported by the compensation unit so as to be movable relative to the forming unit, in particular in order to facilitate a compensation movement of the support unit relative to the forming unit during a forming of the packaging material tube. Preferentially the support unit is arranged at the forming unit via the compensation unit. Preferably the at least one support element of the support unit is arranged at the at least one forming element of the forming unit via the spring-preloaded compensation element. In particular, the at least one support element is supported by means of the compensation unit so as to be movable relative to the at least one forming element, in particular in order to facilitate a compensation movement of the at least one support element relative to the at least one forming element during a forming of the packaging material tube. Preferentially the support unit comprises at least one further support element, which is arranged on at least one further forming element of the forming unit via a further spring-preloaded compensation element of the compensation unit. In particular, the at least one further support element is supported by the compensation unit so as to be movable relative to the at least one further forming element, in particular in order to facilitate a compensation movement of the at least one further support element relative to the at least one further forming element during a forming of the packaging material tube. However, it is also conceivable that the support unit is arranged on the support surface and is supported by the compensation unit so as to be movable relative to the forming unit, in particular in order to facilitate a compensation movement of the support unit relative to the forming unit during a forming of the packaging material tube, or that the forming unit and the support unit are arranged on the support surface and are supported by the compensation unit so as to be movable relative to each other, in particular in order to facilitate a compensation movement of the forming unit and the support unit relative to each other during a forming of the packaging material tube. The implementation of the horizontal forming device according to the invention allows realizing a compact horizontal forming device, in which a compensation movement of the forming unit and/or the support unit during a forming of the packaging material tube is enabled in a constructionally simple manner. Advantageously a precise guiding of the packaging material web during a forming of the packaging material tube is achievable, in particular also in the case of a variation of a maximum thickness of the packaging material web. It is advantageously possible to counteract a summing-up of movement tolerances.

It is further proposed that the compensation unit comprises at least one carrier element, which is fastened to at least one, in particular the at least one aforementioned, forming element of the forming unit, wherein at least one support element of the support unit is supported movably at the carrier element, in particular by means of a spring-preloaded parallelogram guiding of the compensation unit. Preferably the spring-preloaded compensation element is a component of the parallelogram guiding. In particular, the carrier element has a main extension axis running at least substantially parallel to the support surface and/or to the transport direction. By a "main extension axis" of an object is in particular an axis to be understood which runs parallel to a longest edge of a smallest geometric rectangular cuboid just still completely enclosing the object. In particular, the compensation unit comprises at least one further carrier element, which is fastened to the at least one further forming element of the forming unit, wherein the at least one further support element of the support unit is movably supported at the further carrier element, in particular by means of a further spring-preloaded parallelogram guiding of the compensation unit. In particular, the carrier element and the further carrier element are arranged at the forming unit symmetrically, in particular mirror-symmetrically. The implementation of the horizontal forming device according to the invention advantageously allows achieving a precise guiding of the packaging material web during a forming of the packaging material tube, in particular also in the case of a variation of a maximum thickness of the packaging material web. Advantageously it is possible to counteract a summing-up of movement tolerances.

Moreover, it is proposed, in particular alternatively or additionally, that the compensation unit comprises at least one actuator, which is configured to actively move the forming unit and/or the support unit during a forming of the packaging material tube, in particular in order to facilitate a compensation movement of the forming unit and/or the support unit relative to each other during a forming of the packaging material tube. For the purpose of enabling a compensation movement of the forming unit and/or the support unit relative to each other during a forming of the packaging material, the actuator may be operatively connected only with the forming unit, only with the support unit, or with the forming unit and the support unit. The actuator may be embodied as a servomotor, as an actuatable hydraulic or pneumatic cylinder or as a different actuator that is deemed expedient by someone skilled in the art. The actuator may be provided alternatively or additionally to the gear of the compensation unit. The implementation of the horizontal forming device according to the invention enables a compensation movement of the forming unit and/or the support unit during a forming of the packaging material tube in a constructionally simple manner. Advantageously a stable production process is rendered possible.

It is also proposed that the compensation unit comprises at least one sensor element for a detection of a packaging material web parameter, the actuator being actuatable depending on the detected packaging material web parameter. Preferably the packaging material web parameter is a parameter describing a state, a geometry, an orientation, an arrangement, or a different parameter of the packaging material web deemed expedient by someone skilled in the art. The packaging material web parameter may, for example, be a maximum thickness of the packaging material web, a discontinuity in or at the packaging material web, a connection region of the packaging material web with a further packaging material web or a different packaging material web parameter that is deemed expedient by someone skilled in the art. The sensor element may be embodied as a light barrier, as a camera, as a feeler or as a different sensor element that is deemed expedient by someone skilled in the art. By means of the implementation of the horizontal forming device according to the invention, a high degree of automatization is advantageously achievable. A compensation movement of the forming unit and/or the support unit during a forming of the packaging material tube is facilitated in a constructionally simple manner. Advantageously a stable production process is enabled.

Beyond this a packaging machine, in particular a horizontal flow pack machine, with at least one horizontal forming device according to the invention is proposed. Preferably the packaging machine comprises, in particular in addition to the horizontal forming device, at least the packaging material wind-off unit, the packaging material feeding unit, the product feeding unit, the longitudinal sealing unit and the transversal sealing unit. It is conceivable that the packaging machine comprises further units deemed expedient by someone skilled in the art, like for example a form-guiding unit, a heating unit, a negative-pressure unit, in particular an air suction, or the like. The form-guiding unit is preferentially configured for further guiding the packaging material web at least substantially perpendicularly to the run-in direction of the packaging material web at the forming unit, in particular along the transport direction of the packaging material web, while maintaining the homogeneous material tension generated by the forming unit, in particular by the folding edge. In particular, the form-guiding unit is arranged along the transport direction of the packaging material web downstream of the forming unit, and in particular upstream of the longitudinal sealing unit. Preferably the form-guiding unit comprises at least one, in particular three-dimensional, form-guiding contour, which is configured to support the guided packaging material web, in particular at least an outer edge of the packaging material web, in particular for an implementation of a maintaining of the homogeneous material tension. Preferably the form-guiding unit comprises at least two form-guiding contours, which are in particular arranged mirror-symmetrically with respect to an imaginary symmetry plane extending at least substantially parallel to the transport direction of the packaging material web, in which in particular the transport direction of the packaging material web runs, and which extends at least substantially perpendicularly to the folding edge of the forming unit. Preferably the form-guiding unit is implemented mirror-symmetrically, in particular with respect to the imaginary symmetry plane. Alternatively it is conceivable that the form-guiding unit and/or the forming unit are/is implemented in an asymmetrical fashion. Preferably the form-guiding unit is realized free of rollers for a deflection of the packaging material tube, in particular as a further forming shoulder. In particular, the form-guiding unit may have a geometry that is at least substantially analogous to a geometry of the forming unit. The form-guiding unit may be arranged on a side of the support surface, in particular above the support surface, facing toward the forming unit or on a side of the support surface, in particular underneath the support surface, facing away from the forming unit.

The horizontal forming device may comprise at least one heating unit, which is configured to at least section-wise heat the forming unit and/or the form-guiding unit, in particular for a heat input into a seam region of the packaging material web. In particular, the heating unit is configured to enable a heat input into the packaging material web, in particular the packaging paper, upstream of a sealing, in particular a longitudinal sealing, of the packaging material web, in particular the packaging paper. It is alternatively or additionally conceivable that the heating unit is configured to pre-heat the packaging material web, in particular the packaging paper, to seal the packaging material web, in particular the packaging paper, in particular at the form-guiding unit, in particular alternatively to a sealing by the longitudinal sealing unit, and/or to ensure an increased heat input, in particular in a region of the support contour of the form-guiding unit. The heating unit may in particular be realized as a heating coil, as a heating cartridge, as a heating panel, as a thick-film heating element or as another heating unit that is deemed expedient by someone skilled in the art. Preferably the heating unit is arranged at the forming unit and/or at the form-guiding unit, and is in particular in a direct contact with the forming unit and/or the form-guiding unit. In particular, the horizontal forming device may comprise a plurality of heating units, wherein at least one respective heating unit may be allocated to the forming unit and at least one respective further heating unit may be allocated to the form-guiding unit. In particular, the heating unit is arranged on a side of the forming unit and/or of the form-guiding unit that faces away from a contact surface with the packaging material web, in particular the packaging paper. In addition, a heating unit is conceivable that is arranged parallel to a surface of the forming unit, in particular spaced apart from the forming unit, and which heats the packaging material web on an inner side. In particular, the forming unit and/or the form-guiding unit are/is configured to transfer thermal energy received from the heating unit to the packaging material web, in particular the packaging paper. In particular, the forming unit, in particular the forming elements of the forming unit, and/or the form-guiding unit, in particular forming elements of the form-guiding unit, are/is implemented of a thermally conductive material, in particular of a metal. In particular, the forming unit and/or the form-guiding unit are/is configured, at the contact surface with the packaging material web, in particular the packaging paper, to transfer a thermal energy provided by the heating unit to the packaging material web, in particular in the seam regions. In particular, at least one sealing layer of the packaging material web, in particular the packaging paper, is activatable by a heat input in the seam regions. Advantageously, efficient sealing of the packaging material web, in particular the packaging paper, is enabled.

The horizontal forming device may furthermore comprise at least one air pressure unit, which is configured to apply a negative pressure and/or a positive pressure onto the packaging material web at the forming unit and/or at the form-guiding unit. By a "negative pressure" is in particular an air pressure to be understood which is lower than an ambient air pressure of the horizontal forming device. By a "positive pressure" is in particular an air pressure to be understood which is higher than an ambient air pressure of the horizontal forming device. The air pressure unit may in particular be realized as a blower, as an aspirator, or as a different air pressure unit deemed expedient by someone skilled in the art. In particular, the horizontal forming device may comprise a plurality of air pressure units, wherein at least one respective air pressure unit may be allocated to the forming unit and at least one respective further air pressure unit may be allocated to the form-guiding unit. In particular, the air pressure unit is arranged on the side of the forming unit and/or of the form-guiding unit that faces away from the contact surface with the packaging material web, in particular with the packaging paper. Preferentially the forming unit, in particular the forming elements of the forming unit, and/or the form-guiding unit, in particular the form-guiding elements of the form-guiding unit, are/is realized at least section-wise perforated, in particular made of a porous material. In particular, air of an airflow generated by the air pressure unit may flow at least section-wise through the forming unit and/or the form-guiding unit. Preferably the air pressure unit is configured to generate a negative pressure for suctioning the packaging material web to the forming unit and/or to the form-guiding unit, in particular so as to bring about low-crease adjoining of the packaging material web at the forming unit and/or at the form-guiding unit. Preferably the air pressure unit is configured for generating a positive pressure so as to create an air cushion at the forming unit and/or at the form-guiding unit, in particular for implementing low-friction transport of the packaging paper along the forming unit and/or along the form-guiding unit. Preferentially the air pressure unit is switchable between a generation of a negative pressure and a generation of a positive pressure, in particular depending on an application situation, for example depending on a packaging material used. Advantageously a transport of the packaging paper is enabled that is particularly gentle for the material. It is advantageously possible to provide a packaging machine that allows a packaging of products that is particularly gentle for the material.

The horizontal forming device according to the invention and/or the packaging machine according to the invention shall herein not be limited to the application and implementation described above. In particular, in order to fulfill a functionality that is described here, the horizontal forming device according to the invention and/or the packaging machine according to the invention may comprise a number of individual elements, components and units that differs from a number given here. Moreover, with regard to the value ranges given in this disclosure, values situated within the limits mentioned shall also be considered as disclosed and as applicable according to requirements.

BRIEF DESCRIPTION OF THE DRAWINGS

Further advantages will become apparent from the following description of the drawings. In the drawings an exemplary embodiment of the invention is illustrated. The drawings, the description and the claims contain a plurality of features in combination. Someone skilled in the art will purposefully also consider the features individually and will find further expedient combinations.

It is Shown in.

DETAILED DESCRIPTION

Figure 1:
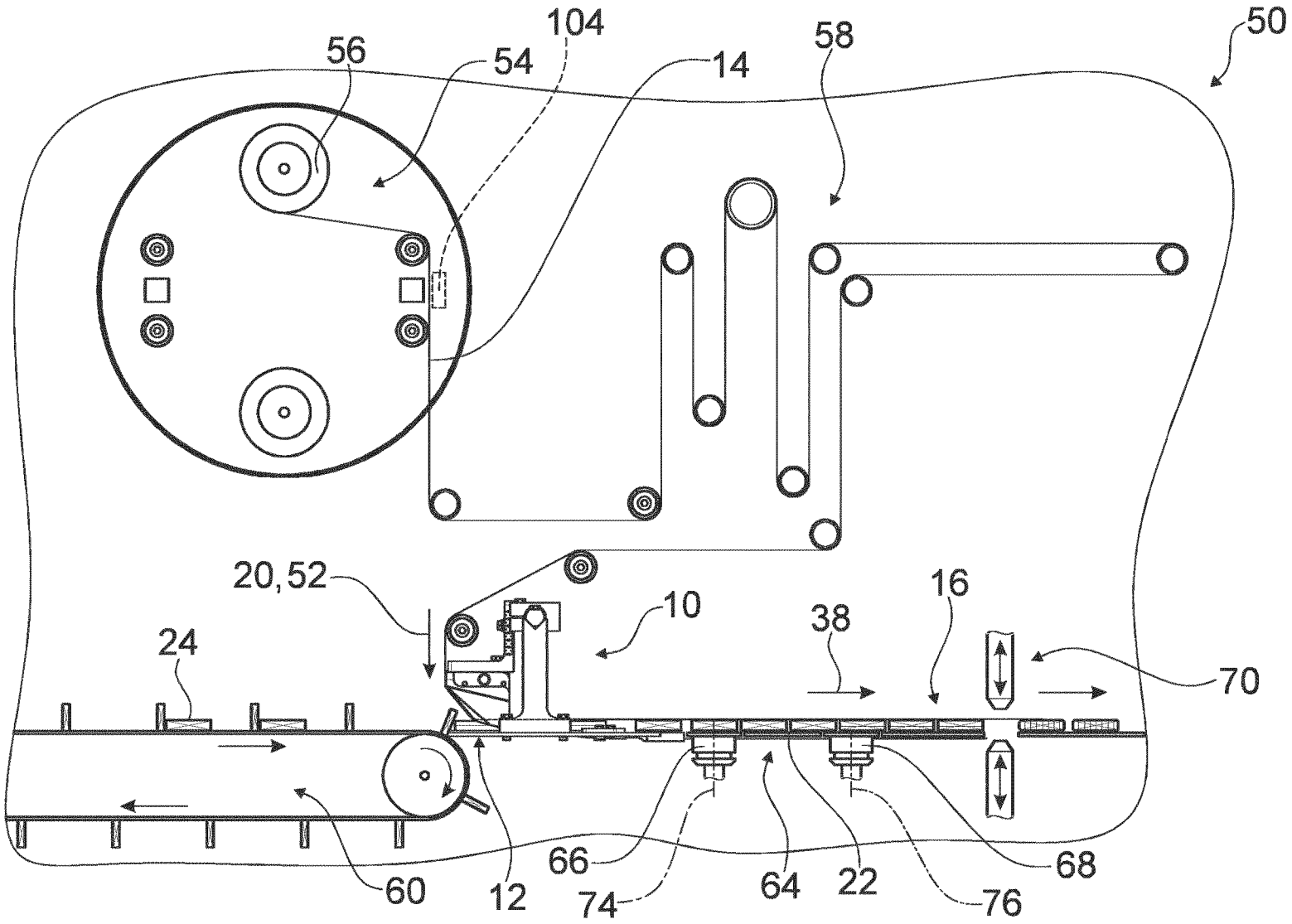
FIG. 1 a portion of a packaging machine according to the invention in a schematic illustration, FIG. 2 a perspective view of a horizontal forming device according to the invention of the packaging machine according to the invention of FIG. 1, in a schematic illustration, FIG. 3 a rear view of the horizontal forming device according to the invention in a schematic illustration, and FIG. 4 a further perspective view of the horizontal forming device according to the invention, free of a support surface of the horizontal forming device according to the invention, in a schematic illustration, in a slightly inclined view from below.

FIG. 1 shows a portion of a packaging machine 50 in a schematic illustration. The packaging machine 50 is embodied as a horizontal flow pack machine. The packaging machine 50 includes a horizontal forming device 10 comprising at least one, in particular roller-free, forming unit 12, in particular a forming shoulder, and at least one support unit 78 (cf. FIG. 2). The forming unit 12 and the support unit 78 are configured for forming a packaging material web 14, in particular a paper web, into a packaging material tube 16, wherein the forming unit 12 and the support unit 78 together delimit a guiding gap 122, 124 (cf. FIG. 3) which the packaging material web 14 can be guided through. It is also conceivable that the horizontal forming device 10, alternatively or additionally, comprises a cover sheet unit covering the products 24 at least during a transport of the products 24. The cover sheet unit may have the same functions as the support unit 78. In particular, the horizontal forming device 10 is configured for guiding the packaging material web 14, in particular the packaging material tube 16, along a horizontal transport direction 38 of the packaging machine 50, which in particular runs at least substantially perpendicularly to a gravity force direction. Preferably the horizontal forming device 10 is configured at least for a forming and/or guiding of the packaging material web 14, the packaging material web 14 being preferentially realized at least largely as a paper web. The packaging material web 14 is preferably made of a paper. Preferably the horizontal forming device 10 may be configured, additionally or at least alternatively, for a forming and/or guiding of a packaging material web that is at least largely made of a material that is realized differently from a paper, for example as a synthetic material. The packaging material web 14, in particular the packaging material tube 16, is in particular configured for a packaging, in particular for an enveloping, of products 24, in particular food products. The packaging material web 14 is preferentially embodied as a packaging paper web.

Preferably the packaging machine 50 comprises at least one packaging material wind-off unit 54 and/or an auxiliary wind-off unit (not shown here in detail), which are/is configured to accommodate the packaging material web 14, in particular as a packaging material reel 56. Preferably the packaging material wind-off unit 54 is configured to wind the packaging material web 14 off, in particular to convey the packaging material web 14 to a packaging material feeding unit 58 of the packaging machine 50. The packaging material feeding unit 58 is preferably configured for feeding the packaging material web 14 to the horizontal forming device 10, in particular to the forming unit 12. The packaging material feeding unit 58 may have a plurality of components, which are in particular known to someone skilled in the art, like for example at least one oscillating lever, at least one centering feeler, at least one web-edge control and/or at least one printing unit for a printing of the packaging material web 14.

In particular, the packaging material tube 16 is configured for enveloping products 24 that are to be packaged. In particular, the packaging machine 50 comprises at least one product feeding unit 60, in particular a conveyor belt, a driver chain, or the like, which is configured to transport the products 24 that are to be packaged, for an enveloping by the packaging material tube 16, into a region of the horizontal forming device 10, in particular of the forming unit 12. Preferably the products 24 can be transported along the transport direction 38 by means of the product feeding unit 60.

Preferably the packaging machine 50 comprises at least one longitudinal sealing unit 64, which is configured to create, in particular by pressure onto the material of the packaging material tube 16 and/or by heat input into the material of the packaging material tube 16, a longitudinal sealing seam of the packaging material tube 16, which in particular extends at least substantially parallel to the transport direction 38. The longitudinal sealing unit 64 is arranged along the transport direction 38 downstream of the horizontal forming device 10, in particular downstream of a form-guiding unit 18 (cf. FIGS. 3 and 4) of the horizontal forming device 10. Preferentially the longitudinal sealing unit 64 comprises at least one pair of sealing rollers 66, 68, which are in particular heatable, profiled and/or subjectable to pressure, and which are configured to transport the packaging material tube 16, in particular via rotation. Preferably the longitudinal sealing unit 64 comprises a plurality of pairs of sealing rollers 66, 68, wherein at least a first pair of sealing rollers 66, which is arranged along the transport direction 38 downstream of the horizontal forming device 10, is implemented free of heating, in particular for a heating-free transport of the packaging material tube 16. Preferably the packaging machine 50 comprises at least one transversal sealing unit 70, which is configured, in particular after respectively one product 24, to create, in particular by pressure onto the material of the packaging material tube 16 and/or by heat input into the material of the packaging material tube 16, transversal sealing seams of the packaging material tube 16, which in particular extend at least substantially perpendicularly to the transport direction 38 of the packaging material tube 16. Preferably the transversal sealing unit 70 is configured for singulating the packaging material tube 16 into individual packagings, which in particular enclose in each case at least one product 24. The transversal sealing unit 70 is arranged along the transport direction 38 downstream of the longitudinal sealing unit 64. The forming unit 12 is preferably configured to deflect the packaging material web 14. In particular, the packaging material feeding unit 58 is configured to feed the packaging material web 14 to the forming unit 12 along a direction, in particular a run-in direction 20, which runs transversely, in particular at least substantially perpendicularly, to the transport direction 38 and at least substantially parallel to the gravity force direction 52.

Figure 2:
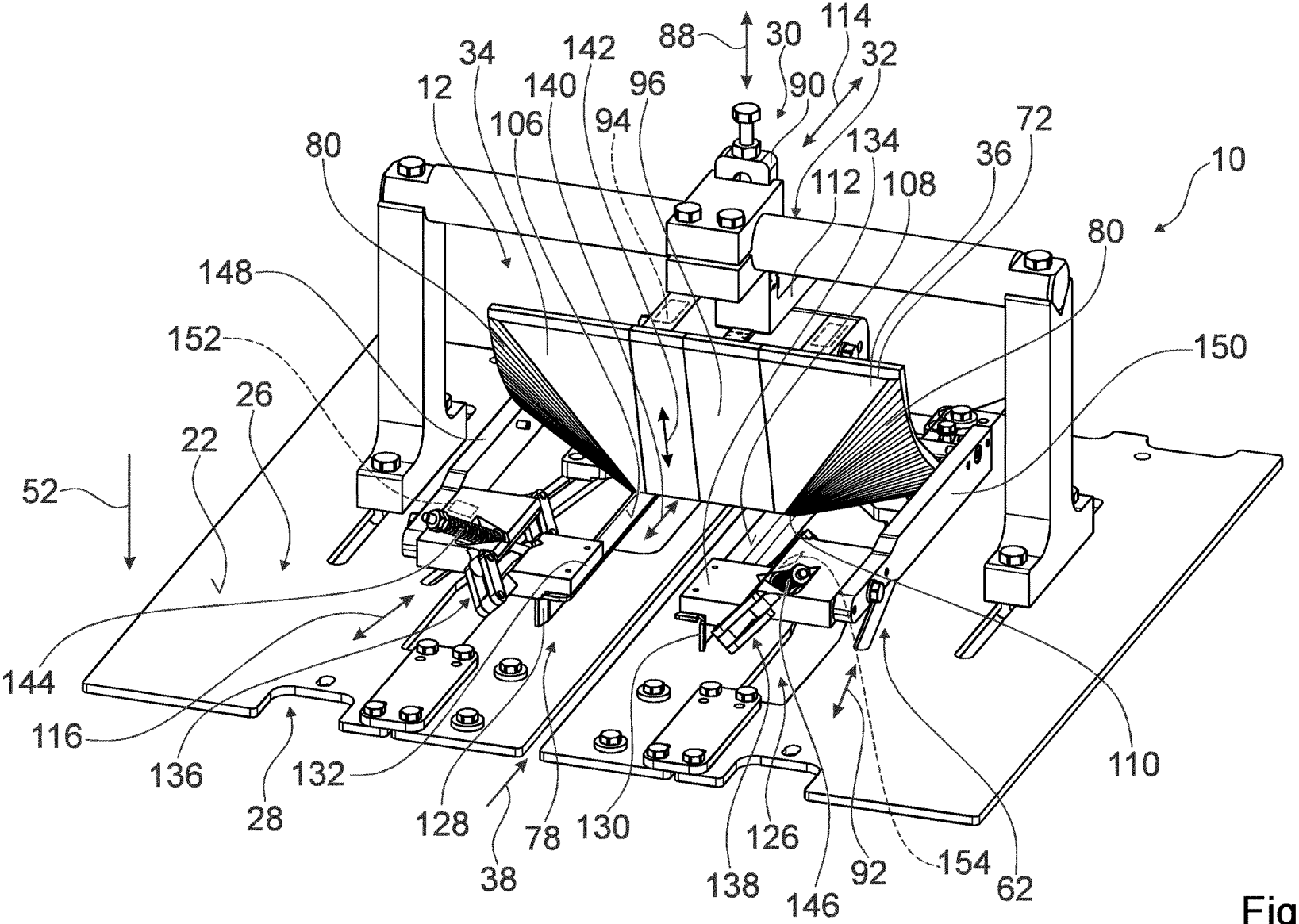

FIG. 2 shows the horizontal forming device 10 of the packaging machine 50 in a state when demounted from the packaging machine 50. Preferentially the horizontal forming device 50 comprises at least one, in particular the aforementioned, form-guiding unit 18, in particular a further forming shoulder, which is configured for further guiding the packaging material tube 16 transversely to a run-in direction, in particular transversely to the aforementioned run-in direction 20, of the packaging material web 14 at the forming unit 12 while maintaining an, in particular homogeneous, material tension generated by the forming unit 12. The forming unit 12 preferably comprises at least one folding edge 72, around which the packaging material web 14 is deflectable. Preferentially the folding edge 72 is realized as a shoulder edge and the forming unit 12 is realized as a forming shoulder. In particular, the forming unit 12 is realized free rollers for a deflection of the packaging material web 14. Preferably the forming unit 12 is configured to deflect the packaging material web 14 at the folding edge 72 in a direction transversely to the run-in direction 20 of the packaging material web 14 and transversely to the transport direction 38 of the packaging material tube 16. Preferably the folding edge 72 extends at least substantially perpendicularly to the run-in direction 20 of the packaging material web 14 and to the transport direction 38. Preferentially the folding edge 72 and/or at least one further folding edge 110 of the forming unit 12 are/is configured to create a homogeneous material tension in the packaging material web 14. Preferably the folding edge 72 is arranged at least partly at one of the forming elements 34, 36 and at least partly at a further one of the forming elements 34, 36. The further folding edge 110 is preferentially arranged at least partly at one of the forming elements 34, 36 and at least partly at a further one of the forming elements 34, 36. The forming elements 34, 36 are preferably two separate components which are realized mirror-symmetrically to each other.

The form-guiding unit 18 is preferentially configured for further guiding the packaging material web 16 at least substantially perpendicularly to the run-in direction 20 of the packaging material web 14 at the forming unit 12, in particular along the transport direction 38, while maintaining the homogeneous material tension generated by the folding edge 72 and/or by the further folding edge 110. In particular, the form-guiding unit 18 is arranged along the transport direction 38 downstream of the forming unit 12 and in particular upstream of the longitudinal sealing unit 64. Preferably the form-guiding unit 18 is implemented free of rollers for a deflection of the packaging material tube 16, and is in particular implemented as a further forming shoulder.

Preferentially the form-guiding unit 18 is realized, in particular arranged, separately from the forming unit 12. Preferably the form-guiding unit 18 is realized as a discrete component or as a discrete sub-assembly, in particular consisting of two symmetrical components. In particular, the form-guiding unit 18 is arranged spaced apart from the forming unit 12, along a direction that runs at least substantially perpendicularly to the transport direction 38, in particular along the run-in direction 20 of the packaging material web 14, and/or along the transport direction 38. Alternatively, it is conceivable that the form-guiding unit 18 is realized in a one-part implementation with the forming unit 12, in particular as a form-guiding protrusion of the forming unit 12.

Preferentially the horizontal forming device 10 comprises at least one support surface 22, in particular a work plate, on which products 24 that are to be packaged can be transported. The form-guiding unit 18 is preferably arranged at least largely on a side 26 of the support surface 22 that faces toward the forming unit 12 (cf. FIGS. 2 and 3). However, it is also conceivable that the form-guiding unit 18 is arranged at least largely on a side 28 of the support surface 22 that faces away from the forming unit 12. The support surface 22 preferably forms a cargo track, on which the products 24 can be transported, and on which the products 24 can in particular be fed to the forming unit 12, the support unit 78 and/or the form-guiding unit 18 for an enveloping by the packaging material web 14, in particular the packaging material tube 16. The support surface 22 preferably extends at least substantially parallel to the transport direction 38. Preferably the product feeding unit 60, the longitudinal sealing unit 64, in particular the sealing rollers 66, 68, and/or the transversal sealing unit 70 are/is arranged at least section-wise within the support surface 22 and/or extend/s at least section-wise through the support surface 22. Preferentially rotation axes 74, 76 of the sealing rollers 66, 68 of the longitudinal sealing unit 64 run at least substantially perpendicularly to the support surface 22 (cf. FIG. 1). Preferably the forming unit 12 is arranged on a side 26 of the support surface 22 on which the products 24 can be transported and which faces toward the packaging material wind-off unit 54 and the packaging material feeding unit 58.

Figure 3:
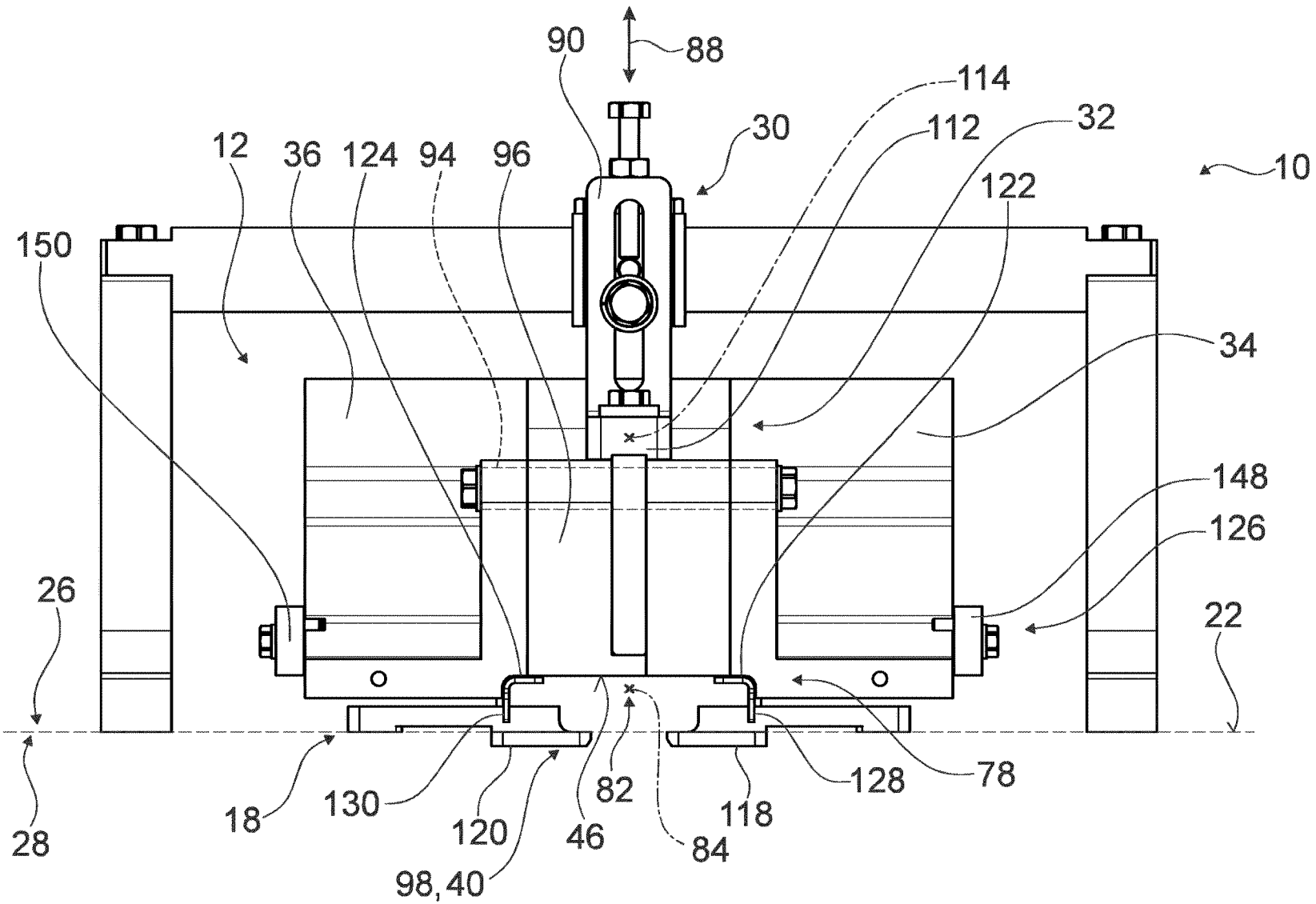

FIG. 3 shows a rear view, in particular an aspect viewed against the transport direction 38, of the horizontal forming device 10. Preferably the forming unit 12 comprises at least one forming tunnel 82, which is configured to guide the packaging material tube 16 along the transport direction 38. In particular, a longitudinal axis 84 of the forming tunnel 82 runs at least substantially parallel to the transport direction 38. The forming tunnel 82 preferably delimits at least partially the guiding gap 122, 124, in particular two guiding gaps 122, 124. The forming tunnel 82 is preferentially arranged at the forming unit 12 on a side of the forming unit 12 that faces toward the support unit 78 and/or toward the support surface 22, and is in particular realized in a one-part implementation with the forming unit 12. The support unit 78 is preferably arranged at least partially in a region of the forming tunnel 82 of the forming unit 12. Preferentially the support unit 78 is implemented at least partly so as to correspond to the forming tunnel 82 of the forming unit 12. In particular, the guiding gap 122, 124, in particular the guiding gaps 122, 124, is delimited by the forming tunnel 82 of the forming unit 12 and by at least that portion of the support unit 78 that is arranged in the region of the forming tunnel 82 of the forming unit 12. Preferentially a distance, in particular a minimum distance, between a wall 46 of the forming tunnel 82 of the forming unit 12 and an outer surface 106, 108 of the portion of the support unit 78 that is arranged in the region of the forming tunnel 82 of the forming unit 12 defines an, in particular maximum, gap width of the guiding gap 122, 124, in particular the guiding gaps 122, 124. The support unit 78 is arranged at least partially within the forming tunnel 82 of the forming unit 12. Preferably the support unit 78 extends at least partially into the forming tunnel 82 of the forming unit 12. The support unit 78 may comprise at least one support element that is formed in a U-shape (not shown here), in particular a U-shaped support element (not shown here) that is formed correspondingly to a U-shaped implementation of the forming tunnel 82 of the forming unit 12; or the support unit 78 comprises at least two, in particular L-shaped, support elements 128, 130, in particular support legs, in particular two L-shaped support elements 128, 130 which are formed correspondingly to a U-shaped implementation of the forming tunnel 82 of the forming unit 12. Preferably, during a forming of the packaging material tube 16, the packaging material web 14 is guided through between the forming unit 12, in particular the forming tunnel 82 of the forming unit 12, and the support unit 78, in particular in a manner that is already known to someone skilled in the art. The forming tunnel 82 in particular extends along the transport direction 38 at least from before the forming unit 12 to the form-guiding unit 18. Preferably the forming tunnel 82 has a greater cross section than the products 24 that are to be packaged. Preferentially the products 24 can be transported through the forming tunnel 82. Preferably the forming unit 12 is configured to form the packaging material tube 16 at least section-wise around the support unit 78, in particular around outer edges of the support elements 128, 130. In particular, the support unit 78 is configured to support the packaging material tube 16.

The forming unit 12 preferably comprises at least two form-contour edges 80 which extend, starting from the folding edge 72, transversely to the folding edge 72, in particular in a V-shape. In particular, the packaging material web 14 is re-formable into the packaging material tube 16 around the form-contour edges 80 and around the further folding edge 110. Preferably the form-contour edges 80 extend along a running direction of the packaging material web 14 and/or along an outer contour of the fed-in products 24, from the folding edge 72 to the further folding edge 110, in particular as far as the forming tunnel 82 of the forming unit 12*a* and/or to the support unit 78. Preferably the form-guiding unit 18 comprises an, in particular three-dimensional, form-guiding contour 86, which is configured to support the guided packaging material tube 16, in particular at least an outer edge of the packaging material tube 16, in particular so as to implement a maintaining of the homogeneous material tension. Preferably the form-guiding unit 18 comprises at least two form-guiding contours 86, which are in particular arranged mirror-symmetrically with respect to an imaginary symmetry plane which extends at least substantially parallel to the transport direction 38, in which in particular the transport direction 38 runs, and which extends at least substantially perpendicularly to the folding edge 72 of the forming unit 12. Preferably the form-guiding unit 18 is realized mirror-symmetrically, in particular with respect to the imaginary symmetry plane.

Alternatively it is conceivable that the form-guiding unit 18 and/or the forming unit 12 are/is realized in an asymmetric fashion.

Preferentially the horizontal forming device 10 comprises at least one adjusting unit 30, 32 (cf. FIG. 2), which is configured, for an implementation of different packaging material tube geometries, to support at least the forming unit 12, the support unit 78 and/or the form-guiding unit 18 so as to be adjustable, in particular in different adjustment planes. Preferably the horizontal forming device 10 comprises at least two adjusting units 30, 32, wherein one adjusting unit 30 is configured to support at least the forming unit 12, the support unit 78 and/or the form-guiding unit 18 so as to be adjustable along an adjustment direction 88 that runs at least substantially perpendicularly to the transport direction 38 and/or to the support surface 22, and at least one further adjusting unit 32 is configured to support at least the forming unit 12, the support unit 78 and/or the form-guiding unit 18 so as to be adjustable along a direction that runs at least substantially parallel to the support surface 22. In particular, different packaging material tube geometries may be required for a packaging of different products 24. In particular, the packaging machine 50 is configured for a packaging of different products 24, which in particular have different dimensions. In particular, different packaging material tube geometries may be required for the packaging of different products 24 having different maximum extensions at least substantially perpendicularly to the support surface 22, in particular different heights, and/or having different maximum extensions at least substantially parallel to the support surface 22 and at least substantially perpendicularly to the transport direction 38, in particular different widths. In particular, a maximum extension of the packaging material tube 16 at least substantially perpendicularly to the support surface 22, in particular a height of the packaging material tube 16, and/or a maximum extension of the packaging material tube 16 at least substantially parallel to the support surface 22 and at least substantially perpendicularly to the transport direction 38, in particular a width of the packaging material tube 16, are/is adjustable via an adjustment of the forming unit 12, of the support unit 78 and/or of the form-guiding unit 18. In particular, it is also possible that an additional adjustment unit 62 is provided (cf. FIG. 2) by means of which, for a correction of uneven tension conditions in the packaging material web 14, the form-guiding unit 18 is adjustable along a direction that runs transversely to the transport direction 38 and at least substantially parallel to the support surface 22. In particular, the forming unit 12, the support unit 78 and/or the form-guiding unit 18 are supported such that they are adjustable as an entire component or as an entire sub-assembly. It is conceivable that the forming unit 12, the support unit 78 and/or the form-guiding unit 18 may be adjustable in themselves, in particular individual components of the forming unit 12 relative to each other, individual components of the support unit 78 relative to each other and/or individual components of the form-guiding unit 18 relative to each other.

In particular, the adjusting unit 30 comprises at least one linear guiding 90, which is configured to support the forming unit 12, the support unit 78 and/or the form-guiding unit 18 so as to be linearly movable along the adjustment direction 88. Preferably the further adjusting unit 32 comprises at least one further linear guiding 112, which is configured to support the forming unit 12, the support unit 78 and/or the form-guiding unit 18 so as to be linearly movable along a further adjustment direction 114 that runs at least substantially perpendicularly to the adjustment direction 88 and at least substantially parallel to the transport direction 38 (cf. FIG. 2). Preferably the additional adjusting unit 62 is configured to support the form-guiding unit 18 so as to be at least linearly movable along an adjustment direction 92, 116 that runs at least substantially parallel to the support surface 22, in particular transversely to the transport direction 38. Preferably the adjusting unit 30, the further adjusting unit 32 and the additional adjusting unit 62 are realized as manual adjusting units for a manual adjustment of the forming unit 12, the support unit 78 and/or the form-guiding unit 18, in particular relative to each other. Alternatively or additionally, it is conceivable that at least one of the adjustment units 30, 32, 62 comprises at least one drivable adjusting element, in particular a servomotor, which is configured for an automatic adjustment of the forming unit 12, the support unit 78 and/or the form-guiding unit 18.

Preferentially the forming unit 12 comprises at least two forming elements 34, 36, in particular forming shoulder legs, which are supported so as to be adjustable relative to each other, in particular in order to enable an adaption of the forming unit 12 to a maximum width of the products 24. Preferably the forming elements 34, 36 of the forming unit 12 are supported so as to be linearly movable relative to each other, in particular adjustably along a direction that runs at least substantially parallel to the folding edge 72, in particular to a folding edge running surface. In particular, the further adjusting unit 32 comprises at least one transversal bearing element 94, which is configured to support the forming elements 34, 36 of the forming unit 12 so as to be at least linearly movable relative to each other. In particular, the forming elements 34, 36 of the forming unit 12 together form the folding edge 72, in particular the folding edge running surface. In particular, the forming elements 34, 36 of the forming unit 12 are supported so as to be movable toward each other and away from each other, in particular along the direction that runs at least substantially parallel to the folding edge 72. Preferably the forming elements 34, 36 of the forming unit 12 together form the forming tunnel 82 of the forming unit 12. In particular, respectively one forming element of the forming elements 34, 36 of the forming unit 12 in each case forms at least one forming-contour edge 80 of the forming unit 12. The further adjusting unit 32 preferably comprises at least one intermediate element 96, in particular a plurality of intermediate elements 96, for filling a space between two forming elements 34, 36 of the forming unit 12 which have been moved away from each other, in particular in order to ensure different product widths. It is however also conceivable that the adjusting unit 32 is implemented free of the intermediate element 96, in particular free of the intermediate elements 96, and the forming elements 34, 36 are arrangeable spaced apart from each other free of the intermediate element 96, in particular free of the intermediate elements 96, in order to realize an adjustment of a position of the forming elements 34, 36.

Preferably the form-guiding unit 18 comprises at least two forming elements 118, 120, which are supported so as to be adjustable relative to each other, in particular in a linearly movable and/or pivotably movable manner. Preferably the forming elements 118, 120 of the form-guiding unit 18 are supported so as to be adjustable relative to each other at least in a linearly movable manner. Alternatively or additionally, the forming elements 118, 120 of the form-guiding unit 18 may be supported so as to be adjustable relative to each other at least in a pivotable manner, in particular in a pivoting plane that extends at least substantially parallel to the support surface 22, in particular for an adjustment of the width of the packaging material tube 16. In particular, in an alternative implementation, the forming elements 118, 120 of the form-guiding unit 18 may be supported so as to be pivotably movable at an end region 98 of the forming elements 118, 120 of the form-guiding unit 18 that faces away from the forming unit 12 along the transport direction 38. Preferably the end region 98 of the forming elements 118, 120 of the form-guiding unit 18 may in an alternative implementation be realized, in particular mounted, separately from a remaining region of the form-guiding unit 18. In particular, respectively one forming element of the forming elements 118, 120 of the form-guiding unit 18 in each case forms at least one form-guiding contour 86 of the form-guiding unit 18. Preferably the forming elements 118, 120 of the form-guiding unit 18 are arranged, in particular supported, mirror-symmetrically to each other with respect to the imaginary symmetry plane.

Preferentially the forming elements 118, 120 of the form-guiding unit 18 form a guiding region 40 which tapers in the transport direction 38 in a V-shape and which is configured to bring seam regions of the packaging material tube 16 together which are to be sealed with each other. In particular, the guiding region 40 is configured to bring longitudinal-sealing seam regions of the packaging material tube 16 together. In particular, the forming elements 118, 120 of the form-guiding unit 18 have a greater distance from each other in an end region 100 facing toward the forming unit 12 along a direction that runs at least substantially parallel to the support surface 22 and at least substantially perpendicularly to the transport direction 38 than in the end region 98 that faces away from the forming unit 12. The seam regions of the packaging material tube 16 are in particular regions in which the packaging material web 14, in particular the packaging paper, is sealed, in particular in order to create a sealing seam. In particular, the guiding region 40 is configured to bring the seam regions together in such a way that for a sealing the seam regions can be transported, adjacent to each other, between respectively two sealing rollers 66, 68 of the pairs of sealing rollers 66, 68. Preferably the guiding region 40 ends, in the end region 98 that faces away from the forming unit 12, in a support contour 102 that is formed by the forming elements 118, 120 of the form-guiding unit 18 and is configured to support the packaging material tube 16, in particular the brought-together seam regions, in particular during a further transport to the longitudinal sealing unit 64.

The horizontal forming device 10 comprises at least one compensation unit 126 (cf. FIGS. 2 to 4), which is configured to movably support at least the forming unit 12 and/or the support unit 78 in such a way that the forming unit 12 and the support unit 78 are movable relative to each other at least during a forming of the packaging material tube 16, in particular in order to facilitate a compensation movement of the forming unit 12 and/or of the support unit 78 relative to each other during a forming of the packaging material tube 16. It is conceivable that—in order to facilitate a compensation movement of the forming unit 12 and/or the support unit 78 relative to each other during a forming of the packaging material tube 16—only the forming unit 12 is movably supported by the compensation unit 126, that only the support unit 78 is movably supported by the compensation unit 126 or that the forming unit 12 and the support unit 78 are movably supported by the compensation unit 126. In the exemplary embodiment of the horizontal forming device 10 illustrated in FIGS. 2 to 4, the compensation unit 126 is exemplarily configured to movably support the support unit 78, in particular in addition to the adjusting unit 30 and the further adjusting unit 32. In other exemplary embodiments of the horizontal forming device 10, which are not shown here, it is conceivable that the forming unit 12 is supported by the compensation unit 126 so as to be movable relative to the support unit 78, or that the forming unit 12 and the support unit 78 are supported so as to be movable relative to each other.

The compensation unit 126 preferably comprises an adjusting function for an adjustment of a gap width of the guiding gap 122, 124, in particular the guiding gaps 122, 124. The compensation unit 126 is preferentially configured to support the support unit 78 movably in such a way that the support unit 78 is movable relative to the forming unit 12 during a running operation of the packaging machine 50 that comprises the horizontal forming device 10. The compensation unit 126 is preferentially configured to support the support unit 78 movably in such a way that while the packaging material web 14 is running through the guiding gap 122, 124, in particular the guiding gaps 122, 124, the support unit 78 is movable relative to the forming unit 12, in particular in the case of a variation of a maximum thickness of the packaging material web 14, due for example to a connection element, in particular an adhesive splice tape, arranged at the packaging material web 14, due to an at least temporarily double-layer packaging material web 14, or something like that, after an exchange of the packaging material web 14 or something like that, while the packaging material web 14 is running through the guiding gap 122, 124, in particular the guiding gaps 122, 124. The support unit 78 is actively movable by means of the compensation unit 126, or the support unit 78 may be supported movably by means of the compensation unit 126 in such a way that the support unit 78 is moved passively relative to the forming unit 12, as a consequence of the packaging material web 14 running through the guiding gap 122, 124, in particular the guiding gaps 122, 124, in particular in the case of a variation of a maximum thickness of the packaging material web 14, like for example due to a connection element, in particular an adhesive splice tape or something like that, arranged on the packaging material web 14, after an exchange of the packaging material web 14 or something like that. Due to the movable support by the compensation unit 126, the support unit 78 is capable of executing an evasive movement, in particular in the case of a variation of a maximum thickness of the packaging material web 14. The compensation unit 126 may be configured, in order to enable a compensation movement during a forming of the packaging material tube 16, to movably support the entire support unit 78 or may be configured to movably support only individual elements of the support unit 78.

Figure 4:
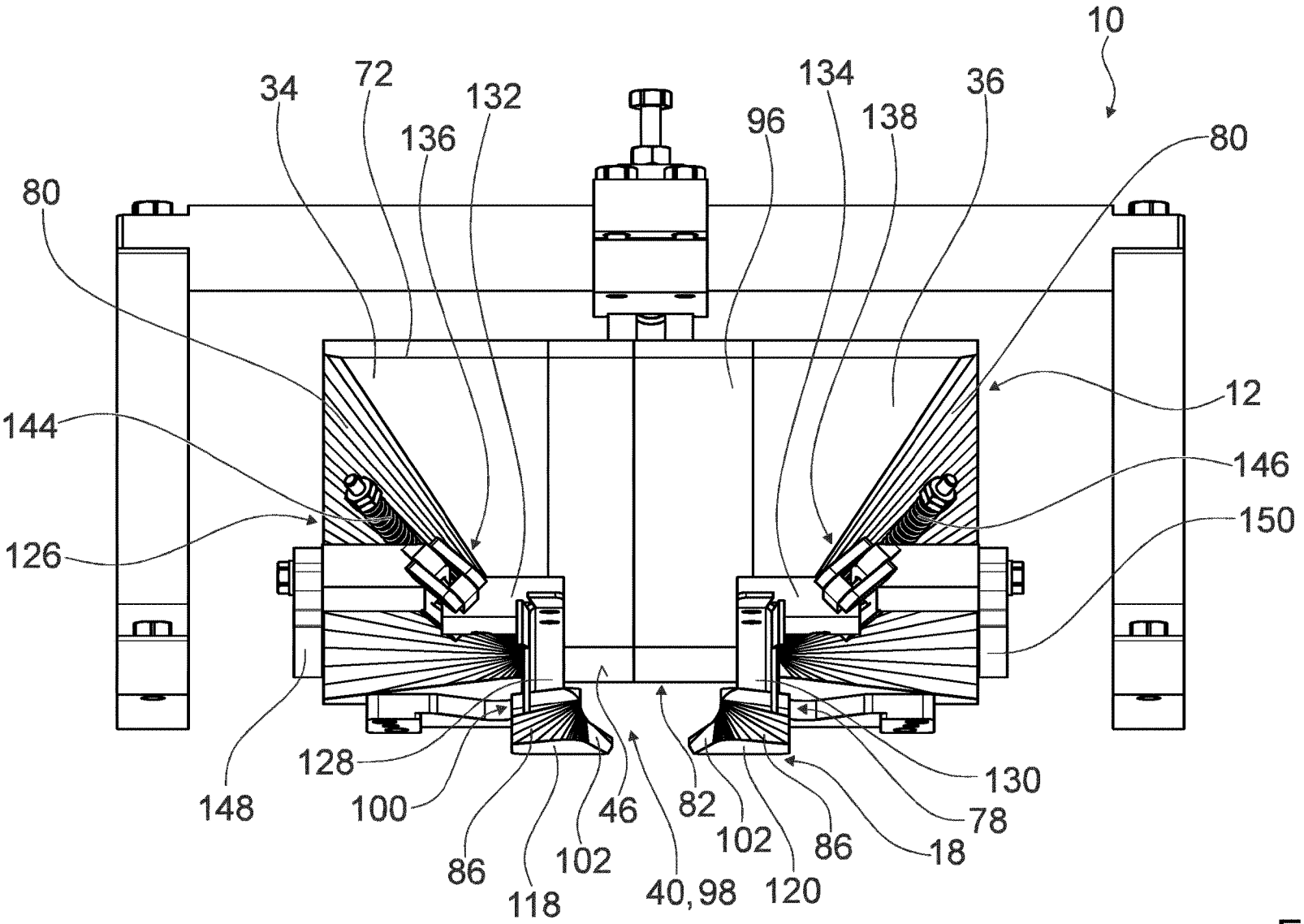

The compensation unit 126 is configured to movably support at least one of the support elements 128, 130, in particular respectively one of the support elements 128, 130, of the support unit 78 by means of at least one spring-preloaded compensation element 132, 134 of the compensation unit 126 (cf. FIGS. 2 and 4). It is however also conceivable that in an alternative implementation of the horizontal forming device 10, which is not illustrated here, the compensation unit 126 is configured to movably support at least one of the forming elements 34, 36, in particular respectively one of the forming elements 34, 36 of the forming unit 12, by means of at least one spring-preloaded compensation element 132, 134 of the compensation unit 126. Preferably the, in particular respective, spring-preloaded compensation element 132, 134 is with at least one side arranged at the, in particular respective, support element 128, 130, in particular fixed thereto. It is however also conceivable that the, in particular respective, spring-preloaded compensation element 132, 134 is embodied in a one-part implementation with the, in particular respective, support element 128, 130. The support element/s 128, 130 is/are preferably supported by the, in particular respective, spring-preloaded compensation element 132, 134 so as to be flexibly movable. Preferentially the support element/s 128, 130 is/are supported by the, in particular respective, spring-preloaded compensation element 132, 134 in such a way that a basic position or a starting point of a movement of the support element/s 128, 130 is adjustable, in particular flexibly adjustable.

The compensation unit 126 comprises at least one gear 136, 138, in particular at least one guiding gear, for an implementation of a compensation movement of the support unit 78 relative to the forming unit 12. The gear 136, 138 may for example be realized as an eccentric gear allowing a compensation movement of the support unit 78 relative to the forming unit 12, wherein at least one eccentric element of the eccentric gear may be embodied as a spring-preloaded compensation element 132, 134. The gear 136, 138 may be realized as a coupling gear allowing a compensation movement of the support unit 78 relative to the forming unit 12, wherein at least one coupling element of the coupling gear may be realized as a spring-preloaded compensation element 132, 134. It is however also conceivable that the gear 136, 138 has a different implementation, deemed expedient by someone skilled in the art. Preferably the support element/s 128, 130 of the support unit 78 is/are arranged, in particular fixed, on at least one gear element, in particular on the, preferably respective, spring-preloaded compensation element 132, 134. In particular, the support element/s 128, 130 of the support unit 78 is/are movably supported by the gear 136, 138 of the compensation unit 126. Preferably the compensation unit 126 comprises at least two gears 136, 138, wherein respectively one of the gears 136, 138 is allocated to one of the support elements 128, 130.

The gear/s 136, 138 is/are configured to realize a compensation movement along at least two directions 140, 142 which run transversely to each other. Preferably the gear/s 136, 138 is/are configured to realize a compensation movement along a direction running at least substantially parallel to the transport direction 38 and along a direction running at least substantially perpendicularly to the transport direction 38. Preferentially the gear/s 136, 138 is/are configured for an implementation of a superimposition of a translation and a rotation. Preferentially the gear/s 136, 138 is/are embodied as a guiding gear, in particular a parallelogram guiding. It is however also conceivable that the gear/s 136, 138 has/have a different design that is deemed expedient by someone skilled in the art and is suitable to enable an implementation of a compensation movement along at least two directions 140, 142 which run transversely with respect to each other. Preferentially respectively one of the gears 136, 138 is configured for a compensation movement of respectively one of the support elements 128, 130 of the support unit 78 relative to the forming unit 12. Preferably, for an implementation of a compensation movement of the respective support element 128, 130 relative to the forming unit 12, the respective support element 128, 130 can be moved by means of the respective gear 136, 138 away from the forming unit 12 and along the transport direction 38.

The compensation unit 126 comprises at least one preload element 144, 146, in particular at least two preload elements 144, 146, which generate/s a preload force acting against a compensation movement of the support unit 78. Preferably the, in particular respective, preload element 144, 146 is configured to generate a preload force toward a starting position out of which the respective support element 128, 130 of the support unit 78 can be moved for executing a compensation movement. The preload element/s 144, 146 may be embodied as a helical tension spring, as a helical pressure spring, as a plate spring, as an elastomer, as a gas compression spring, as an oil compression spring, as a spring steel, or as a different spring element that is deemed expedient by someone skilled in the art. Preferably the, in particular respective, preload element 144, 146 acts directly or indirectly onto the, in particular respective, compensation element 132, 134, which is arranged at the, in particular respective, support element 128, 130 of the support unit 78.

The support unit 78 is arranged at the forming unit 12 and is supported by the compensation unit 126 so as to be movable relative to the forming unit 12. The support elements 128, 130 are preferably realized and/or arranged at the forming unit 12 mirror-symmetrically to each other. Preferentially the support unit 78 is arranged at the forming unit 12 via the compensation unit 126 (cf. FIGS. 2 to 4). Preferably one of the support elements 128, 130 of the support unit 78 is arranged at one of the forming elements 34, 36 of the forming unit 12 via one of the spring-preloaded compensation elements 132, 134. In particular, at least one of the support elements 128, 130 is supported by the compensation unit 126 so as to be movable relative to one of the forming elements 34, 36. Preferentially a further one of the support elements 128, 130 is arranged at a further one of the forming elements 34, 36 of the forming unit 12 via a further one of the spring-preloaded compensation elements 132, 134 of the compensation unit 126. In particular, the further one of the support elements 128, 130 is supported by the compensation unit 126 so as to be movable relative to the further one of the forming elements 34, 36. However, it is also conceivable that the support unit 78 is arranged at the support surface 22 and is supported by means of the compensation unit 126 so as to be movable relative to the forming unit 12, in particular in order to enable a compensation movement of the support unit 78 relative to the forming unit 12 during a forming of the packaging material tube 16, or that the forming unit 12 and the support unit 78 are arranged at the support surface 22 and are supported by means of the compensation unit 126 so as to be movable relative to each other, in particular in order to enable a compensation movement of the forming unit 12 and the support unit 78 relative to each other during a forming of the packaging material tube 16.

The compensation unit 126 preferably comprises at least one carrier element 148, 150, which is fastened to at least one of the forming elements 34, 36 of the forming unit 12, wherein at least one of the support elements 128, 130 of the support unit 78 is movably supported at the carrier element 148, 150, in particular by means of a spring-preloaded parallelogram guiding of the compensation unit 126. Preferably the spring-preloaded compensation element/s 132, 134 is/are a component of the parallelogram guiding. In particular, the carrier element 148, 150 has a main extension axis that runs at least substantially parallel to the support surface 22 and/or to the transport direction 38. Respectively one of the support elements 128, 130 is connected to respectively one carrier element 148, 150 via respectively one of the gears 136, 138, wherein in each case one of the carrier elements 148, 150 is fastened to one of the forming elements 34, 36. The support elements 128, 130 are preferably movably supported at the respective carrier element 148, 150 via respectively one of the spring-preloaded compensation elements 132, 134, the respective carrier element 148, 150 being fastened to one of the forming elements 34, 36.

Alternatively or additionally, the compensation unit 126 comprises at least one actuator 152, 154 (indicated by dashed lines in FIG. 2), which is configured to actively move the support unit 78 during a forming of the packaging material tube 16, in particular in order to enable a compensation movement of the support unit 78 relative to the forming unit 12 during a forming of the packaging material tube 16. Preferably the compensation unit 126 comprises per each support element 128, 130 an actor 152, 154, which is—additionally or alternatively to the preload element 144, 146 and/or to the compensation element 132, 134—arranged operatively between the carrier element 148, 150 and the support element 128, 130. It is conceivable that the compensation unit 126, in particular in an implementation of the compensation unit 126 with the actuators 152, 154, comprises at least one sensor element 104 (indicated by dashed lines in FIG. 1) for a detection of a packaging material web parameter, wherein the actuator 152, 154, in particular the actuators 152, 154, is/are actuatable depending on the detected packaging material parameter.

The adjusting unit 30 and/or the further adjusting unit 32 are/is configured to support the forming unit 12, the support unit 78 and the compensation unit 126 such that they are together adjustable with respect to the support surface 22. Preferably the forming unit 12, the support unit 78 and the compensation unit 126 are supported so as to be adjustable in at least one adjustment plane that extends on a side 26 of the support surface 22 that faces toward the forming unit 12. In particular, the forming unit 12, the support unit 78 and the compensation unit 126 are supported so as to be adjustable as an entire sub-assembly. Preferably the adjusting unit 30 and/or the further adjusting unit 32 are/is configured to support the forming unit 12, the support unit 78 and the compensation unit 126 such that they are translationally and/or rotationally movable. Preferably the adjusting unit 30 is configured, in particular for an adjustment of a height of the packaging material tube 16, to support the forming unit 12, the support unit 78 and the compensation unit 126 such that they are together translationally movable along the adjustment direction 88 that runs at least substantially perpendicularly to the support surface 22. Preferably the further adjusting unit 32 is configured to support the forming unit 12, the support unit 78 and the compensation unit 126 such that they are together translationally movable along the further adjustment direction 114 that runs at least substantially perpendicularly to the adjustment direction 88 and at least substantially parallel to the transport direction 38.

What is claimed is:

1. A horizontal forming device comprising:

at least one forming unit (12), at least one support unit (78), and at least one compensation unit (126), wherein the at least one forming unit (12) and the at least one support unit (78) are configured for forming a packaging material web (14) into a packaging material tube (16), wherein the at least one forming unit (12) and the at least one support unit (78) together delimit a guiding gap (122, 124) which the packaging material web (14) is guided through, wherein the at least one compensation unit (126) is configured to movably support the at least one forming unit (12) and/or the at least one support unit (78) in such a way that, at least during the forming of the packaging material tube (16), the at least one forming unit (12) and the at least one support unit (78) are movable relative to each other in order to enable a compensation movement of the at least one forming unit (12) and/or the at least one support unit (78) relative to each other during the forming of the packaging material tube (16), wherein the at least one compensation unit (126) is configured to movably support:

(i) at least one forming element (34, 36) of the at least one forming unit (12), or (ii) at least one support element (128, 130) of the at least one support unit (78), or (iii) both (i) and (ii);

by at least one spring-preloaded compensation element (132, 134) of the at least one compensation unit (126).

2. The horizontal forming device according to claim 1, wherein the at least one compensation unit (126) comprises at least one gear (136, 138) for an implementation of the compensation movement of the at least one forming unit (12) and/or the at least one support unit (78).

3. The horizontal forming device according to claim 2, wherein the at least one gear (136, 138) is configured for the implementation of the compensation movement along at least two directions (140, 142) which run transversely to each other.

4. The horizontal forming device according to claim 1, wherein the at least one compensation unit (126) comprises at least one preload element (144, 146), which creates a preload force acting against the compensation movement of the at least one forming unit (12) and/or of the at least one support unit (78).

5. The horizontal forming device according to claim 1, further comprising at least one adjusting unit (30, 32) and at least one support surface (22), on which products (24) that are to be packaged are transported, the at least one adjusting unit (30, 32) being configured to support the at least one forming unit (12), wherein the at least one support unit (78) and the at least one compensation unit (126) are together adjustable relative to the at least one support surface (22).

6. The horizontal forming device according to claim 1, wherein the at least one support unit (78) is arranged at the at least one forming unit (12) and is supported by the at least one compensation unit (126) so as to be movable relative to the at least one forming unit (12).

7. The horizontal forming device according to claim 1, wherein the at least one compensation unit (126) comprises at least one carrier element (148, 150), which is fastened to the at least one forming element (34, 36) of the at least one forming unit (12), wherein the at least one support element (128, 130) of the at least one support unit (78) is supported movably at the at least one carrier element (148, 150).

8. The horizontal forming device according to claim 1, wherein the at least one compensation unit (126) comprises at least one actuator (152, 154), which is configured to actively move the at least one forming unit (12) and/or the at least one support unit (78) during the forming of the packaging material tube (16) in order to facilitate the compensation movement of the at least one forming unit (12) and/or the at least one support unit (78) relative to each other during the forming of the packaging material tube (16).

9. The horizontal forming device according to claim 8, wherein the at least one compensation unit (126) comprises at least one sensor element (104) for a detection of a packaging material web parameter, the at least one actuator (152, 154) being actuatable depending on the detected packaging material web parameter.

10. A packaging machine comprising at least one horizontal forming device according to claim 1.

11. A horizontal forming device comprising:

at least one forming unit (12), at least one support unit (78), and at least one compensation unit (126), wherein the at least one forming unit (12) and the at least one support unit (78) are configured for forming a packaging material web (14) into a packaging material tube (16), wherein the at least one forming unit (12) and the at least one support unit (78) together delimit a guiding gap (122, 124) which the packaging material web (14) is guided through, wherein the at least one compensation unit (126) is configured to movably support the at least one forming unit (12) and/or the at least one support unit (78) in such a way that, at least during the forming of the packaging material tube (16), the at least one forming unit (12) and the at least one support unit (78) are movable relative to each other in order to enable a compensation movement of the at least one forming unit (12) and/or the at least one support unit (78) relative to each other during the forming of the packaging material tube (16), wherein the at least one compensation unit (126) comprises at least one gear (136, 138) for an implementation of the compensation movement of the at least one forming unit (12) and/or the at least one support unit (78).

12. A packaging machine comprising at least one horizontal forming device according to claim 11.

13. A horizontal forming device comprising:

at least one forming unit (12), at least one support unit (78), and at least one compensation unit (126), wherein the at least one forming unit (12) and the at least one support unit (78) are configured for forming a packaging material web (14) into a packaging material tube (16), wherein the at least one forming unit (12) and the at least one support unit (78) together delimit a guiding gap (122, 124) which the packaging material web (14) is guided through, wherein the at least one compensation unit (126) is configured to movably support the at least one forming unit (12) and/or the at least one support unit (78) in such a way that, at least during the forming of the packaging material tube (16), the at least one forming unit (12) and the at least one support unit (78) are movable relative to each other in order to enable a compensation movement of the at least one forming unit (12) and/or the at least one support unit (78) relative to each other during the forming of the packaging material tube (16), wherein the at least one compensation unit (126) comprises at least one preload element (144, 146), which creates a preload force acting against the compensation movement of the at least one forming unit (12) and/or of the at least one support unit (78).

14. A packaging machine comprising at least one horizontal forming device according to claim 13.

* * * * *